US008157300B2

(12) United States Patent
Niskanen et al.

(10) Patent No.: US 8,157,300 B2
(45) Date of Patent: Apr. 17, 2012

(54) SHAPED MEMORY ALLOY DECKLID ACTUATOR

(75) Inventors: Jason David Niskanen, Keswick (CA); Dragan Mrkovic, Newmarket (CA); Andrew R. Daniels, Sharon (CA)

(73) Assignee: Magna Closures Inc., Newmarket (CA)

( * ) Notice: Subject to any disclaimer, the term of this patent is extended or adjusted under 35 U.S.C. 154(b) by 410 days.

(21) Appl. No.: 12/303,385

(22) PCT Filed: Jun. 6, 2007

(86) PCT No.: PCT/CA2007/001002

§ 371 (c)(1), (2), (4) Date: Dec. 4, 2008

(87) PCT Pub. No.: WO2007/140606

PCT Pub. Date: Dec. 13, 2007

(65) Prior Publication Data

US 2009/0250952 A1 Oct. 8, 2009

(51) Int. Cl.
*E05C 3/16* (2006.01)
*E05C 3/06* (2006.01)

(52) U.S. Cl. ..... 292/216; 292/201; 292/DIG. 62

(58) Field of Classification Search ..... 292/216, 292/DIG. 62, 201

See application file for complete search history.

(56) References Cited

U.S. PATENT DOCUMENTS 3,977,913 A * 8/1976 Cabo et al. ..... 148/681
4,478,441 A * 10/1984 Fiordellisi et al. ..... 292/216
4,484,955 A * 11/1984 Hochstein ..... 148/563
4,881,981 A * 11/1989 Thoma et al. ..... 148/563
4,974,885 A * 12/1990 Yokoyama ..... 292/201
5,156,063 A * 10/1992 Kelley ..... 74/501.5 R
5,618,066 A 4/1997 Fu-Hsiang
5,618,069 A * 4/1997 Konchan et al. ..... 292/216
6,092,845 A * 7/2000 Koenig ..... 292/225
6,135,514 A * 10/2000 Kowalewski et al. ..... 292/216
6,279,972 B1 * 8/2001 Brill et al. ..... 292/216
6,310,411 B1 * 10/2001 Viallet ..... 307/125
6,367,253 B2 * 4/2002 Kutlucinar ..... 60/528
6,732,516 B2 5/2004 Butera et al.
6,783,167 B2 8/2004 Bingle et al.
6,835,083 B1 12/2004 Alacqua et al.
6,871,519 B2 3/2005 Butera et al.
6,915,633 B2 7/2005 Kutlucinar
7,364,211 B2 * 4/2008 Niskanen et al. ..... 292/336.3
7,380,843 B2 * 6/2008 Alacqua et al. ..... 292/163

(Continued)

FOREIGN PATENT DOCUMENTS

DE 19916244 C1 9/2000

(Continued)

*Primary Examiner* — Carlos Lugo
(74) *Attorney, Agent, or Firm* — Millman IP

(57) ABSTRACT

The invention is a decklid latch with a SMA actuator. The actuator includes a latch plate with a ratchet rotatably mounted to the latch plate and is pivotal between a released position and an engaged position operable to retain a striker. A pawl is rotatably mounted to the latch plate and is pivotal between a an engaged position operable to retain the ratchet, and a release position operable to allow the ratchet to pivot. An selectively-contractible wire is connected to the pawl by a lost motion connection and is operable to move the pawl to the release position when contracted to actuate the latch. Portions of the selectively contractible wire have been annealed to reduce brittleness. Multiple material crimps are used to further reduce strain on the selectively contractible wire.

21 Claims, 2 Drawing Sheets

U.S. PATENT DOCUMENTS

| | | | | |
|---|---|---|---|---|
| 7,392,080 | B2 * | 6/2008 | Eppstein et al. | 604/20 |
| 7,810,852 | B2 * | 10/2010 | Alacqua et al. | 292/201 |
| 7,992,795 | B2 * | 8/2011 | Minor et al. | 236/103 |
| 2002/0092299 | A1 * | 7/2002 | Kutlucinar | 60/528 |
| 2002/0142119 | A1 * | 10/2002 | Seward et al. | 428/36.9 |
| 2003/0053912 | A1 | 3/2003 | Jacot et al. | |
| 2005/0062329 | A1 | 3/2005 | Alacqua et al. | |
| 2005/0146147 | A1 | 7/2005 | Niskanen et al. | |
| 2005/0184533 | A1 | 8/2005 | Hebenstreit et al. | |
| 2006/0201609 | A1 * | 9/2006 | Edwin et al. | 156/192 |
| 2006/0208500 | A1 * | 9/2006 | Brown | 292/201 |
| 2007/0068721 | A1 | 3/2007 | Browne et al. | |
| 2008/0127684 | A1 * | 6/2008 | Rudduck et al. | 70/77 |
| 2009/0230700 | A1 * | 9/2009 | Arabia et al. | 292/93 |

FOREIGN PATENT DOCUMENTS

| | | | |
|---|---|---|---|
| EP | 1245762 | B1 | 10/2002 |
| EP | 1279784 | | 1/2003 |
| JP | 11-200695 | A | 7/1999 |
| WO | WO 03/093615 | A1 | 11/2003 |

* cited by examiner

SHAPED MEMORY ALLOY DECKLID ACTUATOR

FIELD OF THE INVENTION

The present invention relates to vehicle latches. More specifically, the present invention relates to latches that use a shaped memory alloy (SMA) actuator to release the latch.

BACKGROUND OF THE INVENTION

Existing power release solutions for vehicles occupy substantial space in the vehicle to facilitate the actuator and release mechanism. Today's systems often comprise of many parts resulting in a complex and complicated construction. For example, in power-operated systems such as power release decklid latch, power actuators are utilized to perform the desired function(s). These systems employ electrical motors, speed reducing gear sets, clutches, etc. Such powered systems tend to be complex and costly.

One method of simplifying latch construction is to use SMA wire to actuate the latch instead of traditional actuators. However, SMA wire does not always provide a satisfactory response level, given the cooling times required. Existing SMA flexible cable decklid release mechanisms with traditional binary (Ni—Ti) SMA wire exhibit longer cooling times at elevated operating temperatures within the specified automotive temperature range of −40 C and +80 C.

It is therefore desirable to provide an actuating device to selectively enable manually or remotely controlled actuation in vehicle environment, which is simple, reliable and economical. It is further desirable to provide an actuating device which is fast and reliable. It is also desirable to save space and allow a smaller packing envelope by using a SMA actuator instead of conventional technology.

SUMMARY OF THE INVENTION

According to a first aspect of the invention there is provided an actuator. The actuator includes a latch plate with a ratchet rotatably mounted to the latch plate and is pivotal between a released position and an engaged position operable to retain a striker. A pawl is rotatably mounted to the latch plate and is pivotal between a an engaged position operable to retain the ratchet, and a release position operable to allow the ratchet to pivot. An selectively-contractible wire is connected to the pawl by a lost motion connection and is operable to move the pawl to the release position when contracted to actuate the latch.

According to a second aspect of the invention there is provided an actuator. The actuator includes a plate and an actuating member, movably mounted to the plate and operable to be moved between a first position and a second position. A selectively-contractible wire is connected to the actuating member, and is operable to move the actuating member to one of the first and second positions from the other of the first and second positions to activate the actuator. At least one portion of the selectively-contractible wire has been annealed to reduce its ability to selectively contract.

According to a third aspect of the invention there is provided an actuator. The actuator includes a plate and an actuating member, movably mounted to the plate and operable to be moved between a first position and a second position. A selectively-contractible wire is connected to the actuating member, and is operable to move the actuating member to one of the first and second positions from the other of the first and second positions to activate the actuator. A controller is provided to selectively contract the selectively contractible wire to actuate the latch. At least one multiple material crimp connects the controller to the to the selectively-contractible wire. The multi material crimp includes an inner crimp made of a first material in contact with the selectively-contractible wire and an outer crimp made of a second material.

This invention provides a simple actuator to power release a decklid latch or other such device, with reduced number of elements, is reliable and is economical to produce.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
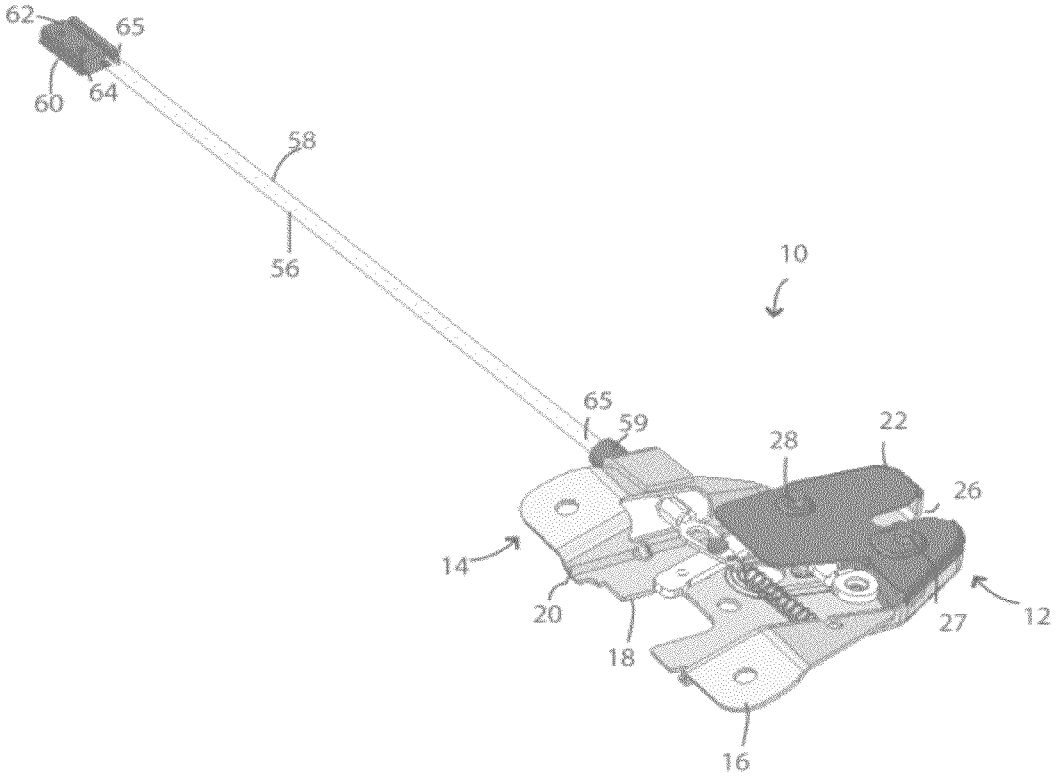
FIG. 1 shows an isometric view of a latch including a shaped memory actuator, in accordance with an embodiment of the invention.
Figure 2:
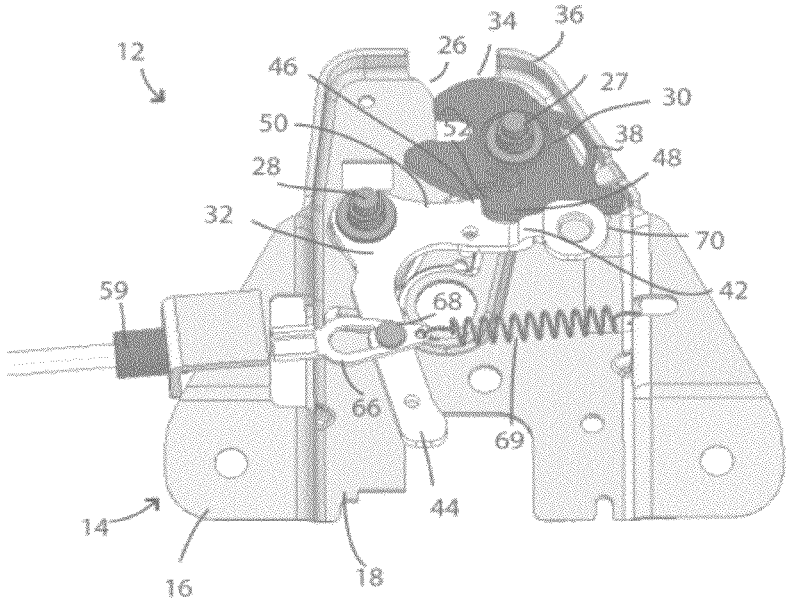
FIG. 2 shows a top plan view of the latch shown in FIG. 1 where the latch plate has been removed.

Referring now to FIGS. 1 and 2, an SMA actuator is shown generally at 10. In the presently-illustrated embodiment, SMA actuator 10 is adapted to provide both powered and manual release for a decklid latch 12. Latch 12 includes a latch plate 14 formed to include two mounting flanges 16 and a recessed portion 18. A web portion 20 interconnects each of mounting flanges 16 with recessed portion 18. A cover plate 22 is mounted over at least a portion of recessed portion 18 to form a compartment therebetween. A frusto-trapezoidal channel, referred to as a "fishmouth" 26 bisects both recessed portion 18 and cover plate 22. Fishmouth 26 is designed to receive a striker (not shown).

Cover plate 22 is secured to plate 14 via fasteners 27 and 28. Within recessed portion 18, a ratchet 30 is rotatably mounted to fastener 27 and a pawl 32 is rotatably mounted to fastener 28. Ratchet 30 is pivotable between an "engagement" position, and a "released" position. The angular travel of ratchet 30 is delimited by a surface 34 on ratchet 30 abutting against a sidewall 36 on plate 18 (the released position), and an overslam bumper 38 on ratchet 30 abutting against sidewall 36. When a striker (not shown) enters fishmouth 26, it rotates ratchet 30 towards the engagement position. A ratchet spring (not shown) urges ratchet 30 towards the released position. Rotating ratchet 30 towards the engagements positions compresses the ratchet spring.

As mentioned earlier, pawl 32 is rotatably mounted to fastener 28 and is pivotal between an "engage" position and a "release position". In the currently-illustrated embodiment, pawl 32 is generally L-shaped, having a first arm 42 and a second arm 44 extending radially from fastener 28. Those of skill in the art will recognize that other embodiments of pawl 32 are within the scope of the art. A ratchet shoulder 46 is provided on first arm 42 to retain ratchet 30 in its engaged position. Pawl 32 is biased towards the engage position by at pawl spring (not shown). As ratchet 30 pivots from its released position to the engaged position, a pivot surface 48 on the ratchet engages a pivot surface 50 on first arm 42, thereby pivoting pawl 32 towards the release position. Once pivot surfaces 48 and 50 pass each other, pawl 32 rotates back to its engage position so that ratchet shoulder 46 on the pawl catches a tooth 52, retaining ratchet 30 in its engaged position.

Latch 12 is electrically actuated via pivoting between its locked and unlocked position via a selectively contractible wire, namely SMA wire 56. SMA wire 56 is formed from a either a binary or ternary shape memory alloy. Preferably, a ternary shape memory alloy comprising nickel, titanium and either palladium or hafnium is used. Depending on the amount of contraction required, only a portion of SMA wire 56 needs to actually be made of a SMA alloy, and the rest can be a less-costly traditional conductive wire. Preferably, a heat-sinking material (not shown) has been extruded over SMA wire 56 as to reduce its cooling time. Also preferably, SMA wire 56 is protected by a non-conductive sheath 58 that is secured at one end to latch plate 14 by a connector 59, and at the other end to a clip 60. Clip 60 is mounted to the decklid or trim panel (neither shown) so that sheath 58 is securely fastened. SMA wire 56 is electrically connected to a pair of terminals 62 and 64 via crimps 63 (FIG. 3) so that SMA wire 56 forms part of a circuit. In the currently illustrated embodiment, terminals 62 and 64 are located within clip 60; however, the invention is not particularly limited and terminals 62 and 64 could be located elsewhere on SMA actuator 10 or located nearby on the vehicle. In their rest state each of the terminals 62 and 64 are connected to a voltage source (typically the vehicle battery). In order to actuate pawl 32, a controller (not shown) selectively connects one of the terminals 62 or 64 to ground, causing the SMA wire 56 to contract.

A lost motion connector such as loop 66 is crimped or otherwise fastened to the other end portion 65 of SMA wire 56. A pin 68 extending from second arm 44 on pawl 32 is located within a slot on loop 66, providing a lost motion connection between SMA wire 56 and pawl 32. It will thus be evident that contracting SMA wire 56 thus actuates pawl 32 to the release position. One end of a SMA return spring 69 is attached to loop 66, so that SMA wire 56 is subsequently stretched back to its original length after actuation.

A manual release loop 70 is present at the end of first arm 42 and is operable to be attached to a key cylinder (not shown) via a rod or cable (also not shown). Thus, in case of electrical failure, latch 12 can still be released manually. As pawl 32 is pivoted manually, pin 68 is able to move generally within loop 66 with minimal interference, and not compressing, bending or damaging SMA wire 56.

Figure 3:
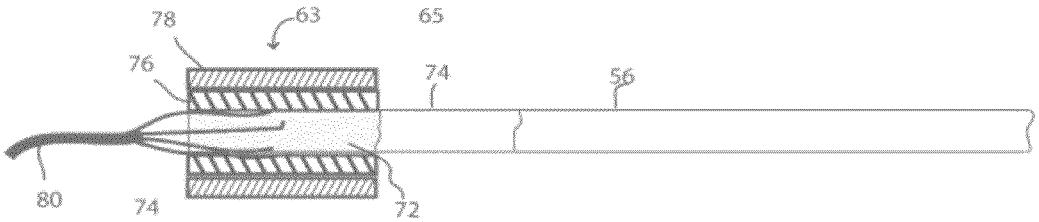
FIG. 3 shows a cross-sectional view of a SMA wire and crimp on the latch shown in FIG. 1

Preferably, portions 72 of SMA wire 56 have been annealed as to reduce their brittleness and resist breakage. Referring now to FIG. 3, an annealed portion 72 of SMA wire 56 is described in greater detail. Annealed portion 72 is created by heating the desired region for a predetermined length of time n order to destroy the crystalline structure providing the shaped memory properties. Thus, annealed portion 72 does not contract when the rest of SMA wire 56 contracts. The length of time required to create annealed portion 72 is determined by the thickness of the SMA wire 56, the length of the wire to be annealed and the alloy composition of the wire. During the annealing process, a transitional region 74 is formed adjacent the annealed portion 72 in the remainder of the SMA wire. The transitional region 74 is partially annealed, but retains a portion of the shaped memory characteristics. The transitional region provides strain relief and helps reduce breakage of SMA wire 56. Presently, the end portions 65 of SMA wire 56 are annealed, but other portions that undergo higher levels of strain could be hardened as well.

As mentioned earlier, SMA wire 56 is electrically connected using crimps 63. Crimps 63 are mounted over annealed portions 72 at the two ends of SMA wire 56 (i.e., within clip 60 and at loop 66). Preferably, crimps 63 are multiple material crimps. Each crimp 63 has a softer inner crimp 76 made of material such as copper or aluminum that is mounted directly to SMA wire 56 in order to reduce stress on the wire. A harder material such as steel is used for the outer crimp 78. A wire 80 is connected to SMA wire 56 within inner crimp 76 to connect SMA wire 56 to one of the electrical terminals 62 and 64.

This invention provides a simple actuator to power release a decklid latch or other such device, with reduced number of elements, and economical to produce.

What is claimed is:

1. An assembly comprising an actuator and a latch, comprising:

a latch including;

a latch plate;

a ratchet, rotatably mounted to the latch plate and pivotal between a released position and an engaged position operable to retain a striker;

a pawl, rotatably mounted to the latch plate and pivotal between an engaged position operable to retain the ratchet, and a release position operable to allow the ratchet to pivot; and an actuator, including:

a selectively-contractible wire, connected to the pawl by a lost motion connection and operable to move the pawl to the release position when contracted to actuate the latch, wherein the selectively-contractible wire is adapted to be controlled by a controller; and a return spring positioned to urge the selectively-contractible wire to extend.

2. The actuator of claim 1, wherein the lost motion connection includes a connector mounted to an end of the selectively-contractible wire, the connector having a slot, and a pin extending from the pawl and slidably located within the slot.

3. The actuator of claim 1, wherein the pawl further includes a manual release loop adapted as to be connected to a key cylinder by one of a rod and a cylinder so that the pawl is moved to the release position to actuate the latch when the key cylinder is rotated.

4. The actuator of claim 3, wherein the pin moves freely within the slot when the pawl is moved between the release position and the engaged position.

5. The actuator of claim 4, wherein the selectively contractible wire is formed at least partially from a shape memory alloy.

6. The actuator of claim 5, wherein the shape memory alloy is a ternary shape memory alloy.

7. The actuator of claim 5, wherein the selectively contractible wire is mounted at the other end to the vehicle by a clip.

8. The actuator of claim 7, wherein the clip includes at least one terminal to electrically connect an end of the selectively contractible wire to a power supply.

9. The actuator of claim 8, further comprising a controller operable to selectively contract the selectively contractible wire to actuate the latch.

10. The actuator of claim 5, wherein at least a portion of the selectively contractible wire is annealed to reduce the ability of the at least a portion to selectively contract.

11. The actuator of claim 10, wherein the at least a portion of the selectively contractible wire annealed includes the ends of the selectively contractible wire.

12. The actuator of claim 5, wherein the selectively contractible wire is covered in a heat-dispersing material.

13. The actuator of claim 2, wherein connector is mounted to the end of the selectively-contractible wire via a multiple material crimp, the multiple material crimp including an inner crimp made of a first material in contact with the selectively-contractible wire and an outer crimp made of a second material.

14. The actuator of claim 13, wherein the first material is softer than the second material.

15. The actuator of claim 14, wherein the outer crimp forms the slot.

16. An actuator, comprising:

a plate;

a selectively-contractible wire, adapted to be connected to an actuatable member, and, in use, operable to move the actuatable member to one of a first position and a second position from the other of the first and second positions, wherein the selectively-contractible wire is adapted to be controlled by a controller; and wherein an end portion of the selectively-contractible wire has been at least partially annealed to reduce the ability of the at least one portion to selectively contract.

17. The actuator of claim 16, wherein the at least one portion of the selectively-contractible wire includes at least one end of the selectively contractible wire.

18. The actuator of claim 17, wherein the selectively contractible wire is formed from a shape memory alloy.

19. The actuator of claim 18, wherein the shape memory alloy is a ternary shape memory alloy.

20. An actuator, comprising:

a plate;

a selectively-contractible wire, adapted to be connected to an actuatable member, and, in use, operable to move the actuatable member to one of a first and a second position from the other of the first and second positions;

a controller operable to selectively contract the selectively contractible wire to actuate the latch; and at least one multiple material crimp connecting the controller to the selectively contractible wire, the multi material crimp including an inner crimp made of a first material and an outer crimp made of a second material, wherein the inner crimp cushions the selectively contractible wire against damage from deformation of the outer crimp.

21. The actuator of claim 20, wherein the first material is softer than the second material.

* * * * *